US008062186B2

(12) United States Patent
Nelson et al.

(10) Patent No.: US 8,062,186 B2
(45) Date of Patent: Nov. 22, 2011

(54) ELLIPTICAL EXERCISE MACHINE

(75) Inventors: Derek L. Nelson, Lake Mills, WI (US); Clinton S. Myers, Sagle, ID (US); Daniel D. Budworth, Milton, WI (US)

(73) Assignee: Johnson Health Tech Co., Ltd. (TW)

( * ) Notice: Subject to any disclaimer, the term of this patent is extended or adjusted under 35 U.S.C. 154(b) by 14 days.

(21) Appl. No.: 12/456,161

(22) Filed: Jun. 12, 2009

(65) Prior Publication Data

US 2010/0317492 A1 Dec. 16, 2010

(51) Int. Cl.
*A63B 22/04* (2006.01)

(52) U.S. Cl. ..... 482/52; 482/62

(58) Field of Classification Search ..... 482/51–52, 482/57, 70, 79–80
See application file for complete search history.

(56) References Cited

U.S. PATENT DOCUMENTS

| | | | | |
|---|---|---|---|---|
| 6,238,321 | B1 * | 5/2001 | Arnold et al. | 482/52 |
| 6,849,032 | B2 * | 2/2005 | Chu | 482/51 |
| 7,276,017 | B2 * | 10/2007 | Chen | 482/52 |
| 7,303,509 | B2 * | 12/2007 | Schroder | 482/52 |
| 7,313,178 | B2 * | 12/2007 | Iadanza | 375/224 |
| D559,925 | S | 1/2008 | Horita | |
| 7,513,854 | B1 * | 4/2009 | Stearns et al. | 482/52 |
| 7,601,102 | B2 * | 10/2009 | Alessandri et al. | 482/52 |
| 7,670,268 | B1 * | 3/2010 | Stearns et al. | 482/52 |
| 7,833,133 | B2 | 11/2010 | Stewart et al. | |
| 2006/0293153 | A1 * | 12/2006 | Porth et al. | 482/52 |
| 2008/0161163 | A1 | 7/2008 | Stewart et al. | |
| 2010/0267524 | A1 | 10/2010 | Stewart et al. | |

OTHER PUBLICATIONS

Black and white print photo of Precor Incorporated AMT® 100i, 1p.
Precor Incorporated, AMT® 100i overview, www.precor.com, 1p.
Precor Incorporated, AMT® 100i product brochure, www.precor.com 2pp.
Precor Incorporated, AMT® 100i product specification, www.precor.com, 1p.

* cited by examiner

*Primary Examiner* — Stephen Crow
(74) *Attorney, Agent, or Firm* — Smith Law Office

(57) ABSTRACT

An exercise machine includes a pair of support members having front ends connected to a crank unit for turning along with the crank unit and rear ends moving along a reciprocating path due to the guidance of a pair of guide members. A pair of foot members are each mounted on the respective support member. Each foot member moves through a substantially elliptical path, and each foot member at least partially overhangs the other foot member during at least a portion of travel along the substantially elliptical path.

19 Claims, 4 Drawing Sheets

ELLIPTICAL EXERCISE MACHINE

BACKGROUND

1. Field of the Invention

This invention relates to an exercise machine, more particularly to an elliptical exercise machine with partially overhanging foot members which permits a user's feet to be placed in a more natural position.

2. Description of the Related Art

The benefits of regular exercise to improve overall health, appearance and longevity are well documented in the literature. Elliptical cross trainers have become one of the most popular exercise machines on the market because of their proven ability to simultaneously exercise both the upper and lower body at the same time, thereby increasing the efficiency of the exercise. Because elliptical cross trainer machines guide the motion of the feet through a smooth, predominantly elliptical-shaped closed-loop path, elliptical cross trainers also offer a smooth, low-impact exercise, minimizing the risk of injury to the back, knees, hips, and ankles.

However, because elliptical cross trainers define the travel path of the user's feet rather than the exerciser defining their own foot motion, there can be discrepancies between the natural motion of the human body and the motion imposed on the exerciser by the elliptical cross-trainer machine.

As one example, stride length is one variable that is defined by elliptical cross trainers. Some people, based on their height or preferences, may want an exercise machine that provides a short stride length, while others may want a longer stride length. Many elliptical cross trainers have been optimized to target a stride length that appeals to a majority of users. Other elliptical cross trainers have adjustable stride length so that a user may increase or decrease the stride length to their individual preferences.

Another variable is stride width, or the spacing between the insoles of the feet. When a person is standing, a comfortable stance is to place the feet approximately shoulder width apart. However, while walking or running, a person tends to decrease their stride width so that they place their feet closer to the centerline of the body. In other words, during walking or running, the stride width narrows, converging toward one foot being placed in-line with the other. This is more akin to walking a tightrope. However, traditional elliptical cross-trainers have, to date, always maintained a relatively large stride width. Unlike a treadmill, where a user can define their own foot motion, and therefore can walk with a natural stride width, an elliptical trainer defines the foot motion for the user, forcing the user to maintain the stride width of the machine.

For exercise equipment, a measurement of this machine-defined stride width is known as Q-Factor. For example, a Q-Factor measurement for a bicycle would traditionally be defined as the distance between the vertical plane defined by the inside edge of the left pedal and the vertical plane defined by the inside edge of the right pedal. Similarly, in the case of an elliptical cross trainer, Q-Factor has traditionally been defined as the distance between the vertical plane defined by the inside edge of the left foot support platform and the vertical plane defined by the inside edge of the right foot support platform.

Because an elliptical cross trainer moves each foot support platform through a substantially elliptical closed loop path, and because the foot platforms must not interfere with each other or with any other component of the elliptical trainer during this travel, the Q-Factors for traditional elliptical trainers have always been positive numbers to prevent interferences. However, this forces a wide stance upon the exerciser, forcing a user to move their feet within two widely-spaced parallel planes. This wide stride width is unnatural.

An object of the present invention is to provide an exercise machine with all of the benefits of a traditional elliptical cross trainer, while allowing the user to chose a very narrow stride width.

Another object of the present invention is to provide an elliptical cross trainer with foot support platforms that move through a closed-loop path without interfering with one another, while having foot support platforms spaced so close to one another that a portion of each foot support platform crosses the centerline of the machine.

SUMMARY

An object of the present invention is to provide an exercise machine with all of the benefits of a traditional elliptical cross trainer, while allowing the user to chose a very narrow stride width.

Another object of the present invention is to provide an elliptical cross trainer with foot support platforms that move through a closed-loop path without interfering with one another, while having foot support platforms spaced so close to one another that a portion of each foot support platform crosses the centerline of the machine.

According to this invention, an exercise machine comprises a frame having a pivot axis defined thereon, a crank unit for rotation around the pivot axis, a left and right guide member connected to the frame, a left and right support member, each support member having a first end, a second distal end, a middle portion, and a distal portion proximate the second end, where the first end is connected to the crank unit so that rotation of the crank unit results in the rotation of the first end of the support member in a substantially circular path around the pivot axis while the distal portion of each support member is guided by the respective guide member to move along a first reciprocating path; and a left and right foot member, each foot member connected to the respective support member in the middle portion of the respective support member, wherein the center of each foot member is located respectively on the left and right side of a vertical plane running along the longitudinal centerline of the exercise apparatus and placed within such close proximity to the vertical plane that a portion of each foot member crosses through the vertical plane.

DETAIL DESCRIPTION

Figure 1:
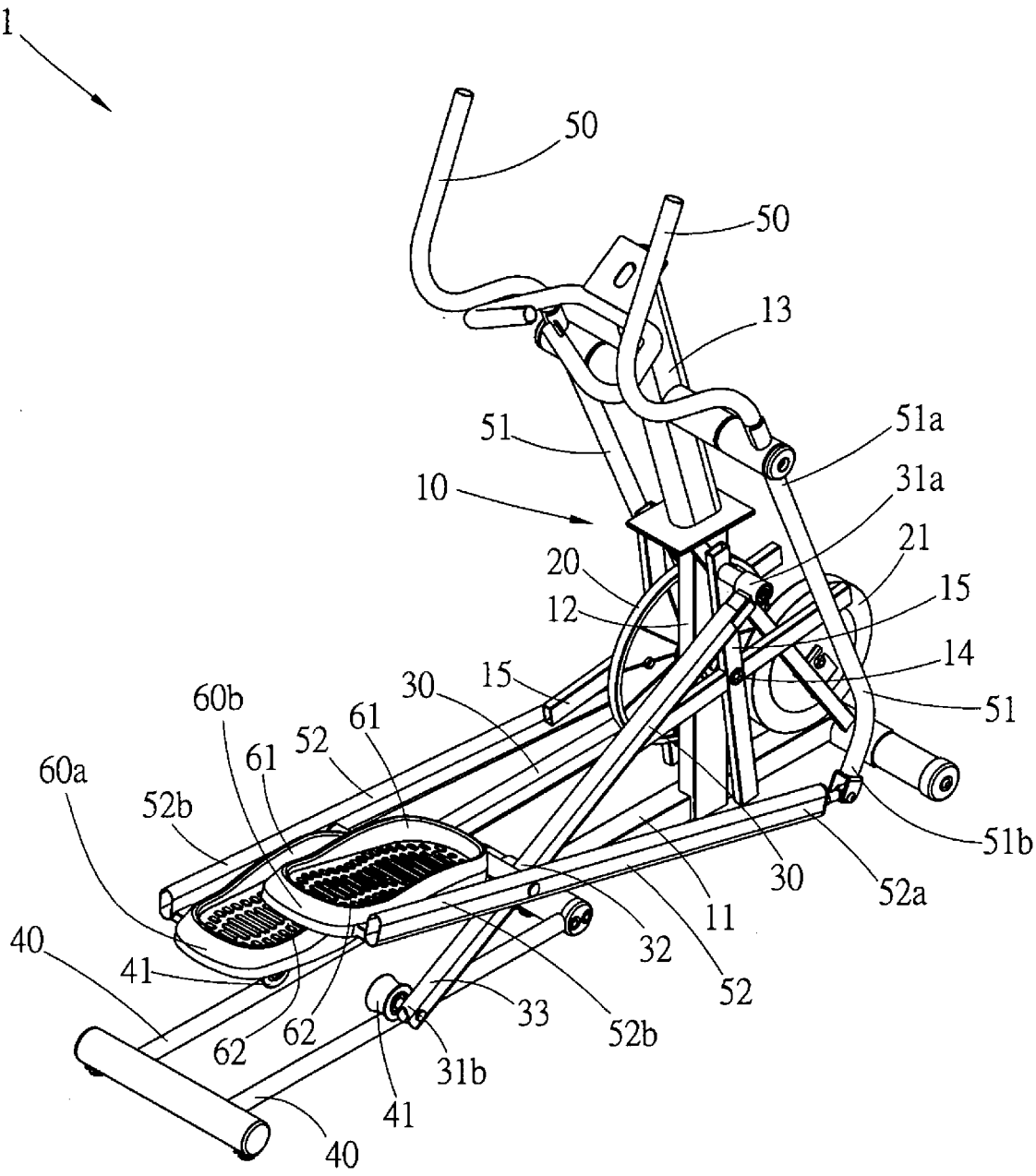
FIG. 1 is a perspective view of an elliptical exercise apparatus according to a preferred embodiment of the present invention.
Figure 2:
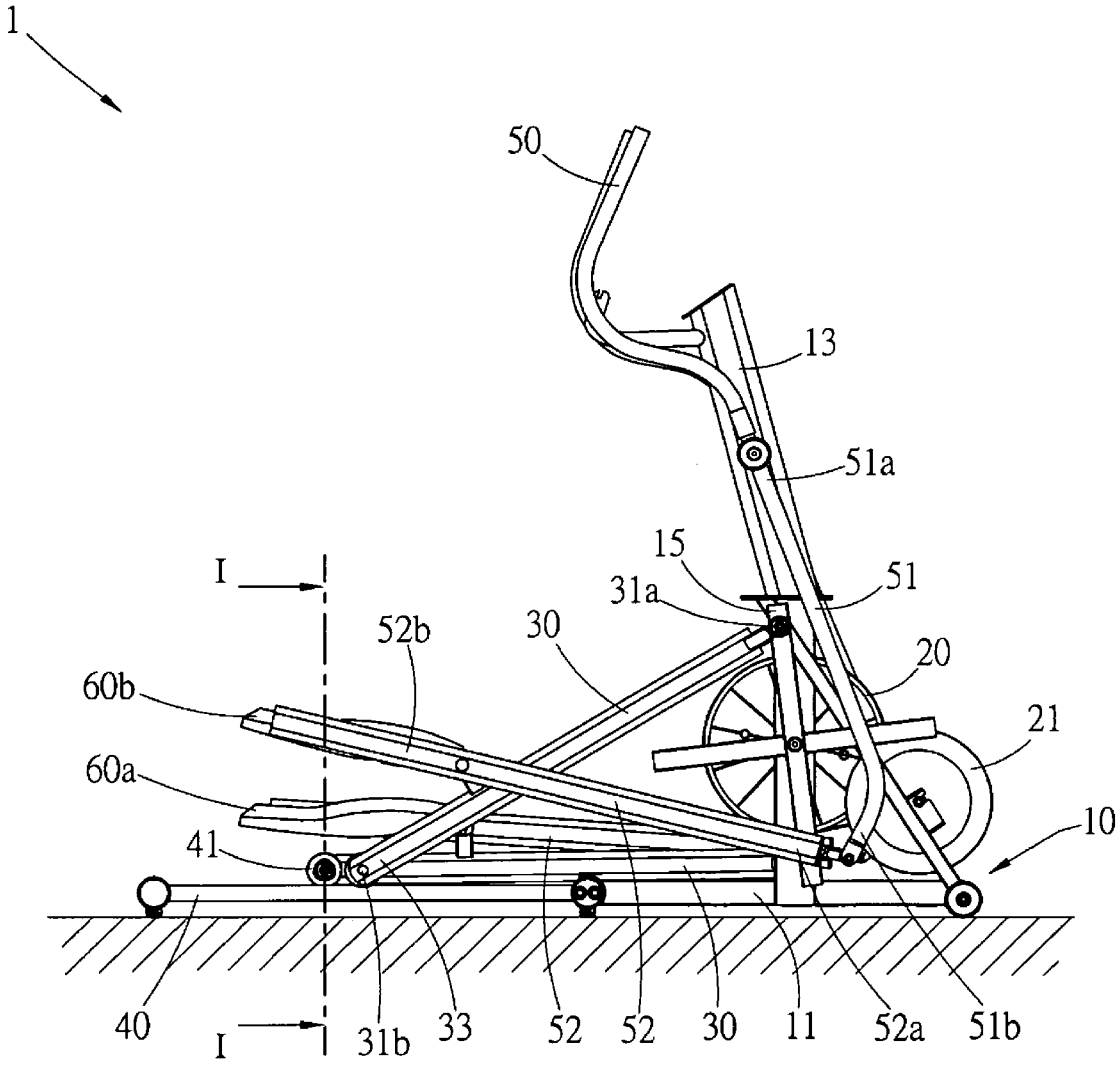
FIG. 2 is a side view of the elliptical exercise apparatus of FIG. 1.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

A preferred embodiment of the present invention applied to an exercise apparatus is depicted in FIG. 1. The preferred embodiment of FIG. 1 is an elliptical exercise apparatus 1 with left and right foot members 60*a*, 60*b* in which at least a portion of the left and right foot members 60*a*, 60*b* each overhang the other for a portion of the time during the exercise.

The elliptical exercise apparatus 1 has a frame 10 adapted to rest on a floor surface and to provide a foundation for other mechanisms to couple thereto. The frame 10 has a base 11, a post 12 mounted at the front of the base 11, and an upright 13 mounted on the top end of the post 12. The frame 10 further comprises a pivot axis 14 associated with post 12 of frame 10 for a rotating member 15 pivotally mounted thereon.

Additionally, there is a pulley 20 pivotally mounted to the frame 10 at pivot axis 14. The pulley 20 and the rotating member 15 are coaxial. At the front portion of the frame 10, there is a flywheel 21 pivotally mounted thereto. As the rotating member 15 rotates around pivot axis 14, the pulley 20 is simultaneously rotated and drives the flywheel 21 to rotate. The flywheel 21 provides inertia to the elliptical exercise apparatus 1 to make the overall exercise process more smooth and comfortable. In addition, persons skilled in the art would recognize that a resistance assembly (not shown) may optionally be configured to the flywheel 21 to allow resistance to be added by a user to change exercise intensity.

As depicted in FIG. 1, each of the left and right support members 30 has a first end 31*a*, a middle portion 32, a distal portion 33 and a distal end 31*b* positioned distally from the first end 31*a*. The first ends 31*a* of the left and right support members 30 are respectively pivotally connected to the left and right rotating members 15. As the rotating member 15 rotates, each of the first ends 31*a* of the left and right support members 30 is driven to move along a circular path. Additionally, there are left and right guide members 40 connected to the base 11 of frame 10. These guide members 40 may be pivotally connected to the base 11, allowing the guide members 40 to be rotated up into a storage position with a smaller overall footprint (not show). Alternatively, these guide members 40 may be slidingly connected to the base 11, allowing the guide members 40 to be slid toward the front end of the exercise apparatus 1 for storage to again allow the exercise apparatus I to be stored with a smaller overall footprint (not shown). Two rollers 41 are respectively pivotally mounted to the distal ends 31*b* of the left and right support members 30. Each of the rollers 41 is respectively engaged with the left and right guide members 40 and guides each of the distal portions 33 of the left and right support members 30 to move along a first reciprocating path. As shown in the preferred embodiment of FIG. 1, each of the first reciprocating paths is substantially a linear path. As the first ends 31*a* of the left and right support members 30 rotate along a circular path around pivot axis 14, the middle portions 32 of the left and right support members 30 move along an approximate elliptical path.

Again referring to FIG. 1, the elliptical exercise apparatus 1 further comprises left and right handles 50, left and right handle links 51 and left and right control links 52. The left and right handles 50 are respectively pivotally mounted to left and right sides of the upright 13 for the user to grip when he exercises. Each of the left and right control links 52 has a front portion 52*a* and a rear portion 52*b*. As shown in FIG. 1, the rear portion 52*b* of the left and right control links 52 are respectively pivotally connected to the middle portions 32 of the left and right supporting members 30. The rear portion 52*b* of the left and right control links 52 are also respectively connected to the left and right foot members 60*a*, 60*b*, thereby fixing the orientation of the left and right foot members 60*a*, 60*b* to the respective left and right control links 52.

As illustrated in FIG. 1, each of the left and right handle links 51 has an upper portion 51*a* and a lower portion 51*b*. The lower portions 51*b* of the left and right handle links 51 are respectively connected to the front portions 52*a* of the left and right control links 52. The upper portions 51*a* of the left and right handle links 51 are respectively connected to the left and right handles 50 and move with the left and right handles 50.

Figure 3:
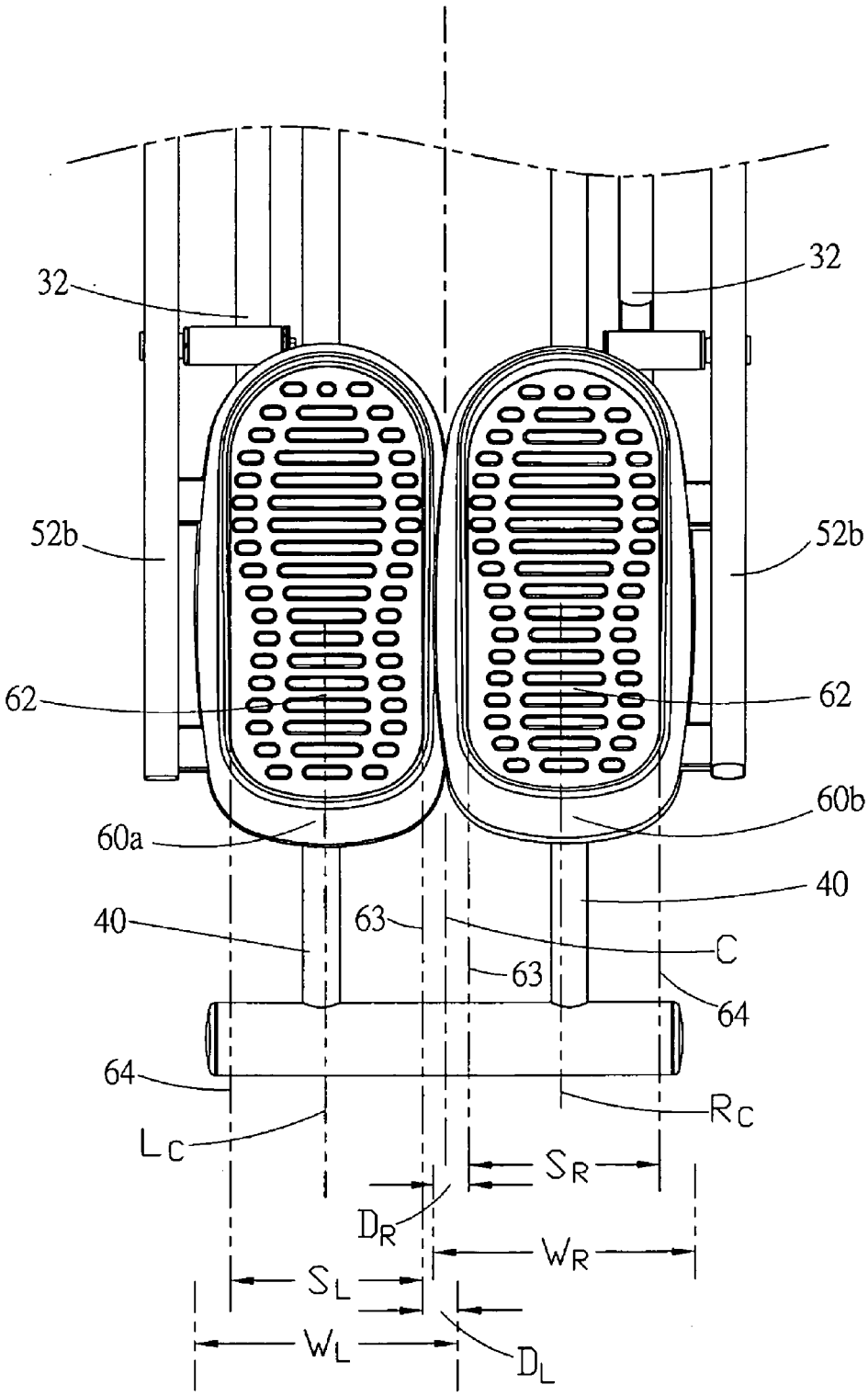
FIG. 3 is a partial top view of FIG. 1, showing the mechanical relationship of left and right foot members.

Referring now to FIG. 3, there is shown plane C which is an imaginary vertical plane running through the longitudinal center line of the elliptical exercise apparatus 1. This vertical longitudinal plane C divides the elliptical exercise apparatus 1 into a left part and right part. As shown, each of the left and right foot members 60*a*, 60*b* is located on either side of the vertical plane C. In other words, there is a portion of left foot member 60*a* that crosses through vertical longitudinal plane C into the right part of exercise apparatus 1, and there is a portion of right foot member 60*b* that crosses through vertical longitudinal plane C into the left part of exercise apparatus 1.

In addition, FIG. 3 shows a close-up of left and right foot members 60*a*, 60*b*, showing a stepping space 62 associated with each foot member 60*a*, 60*b*. Bounding each stepping space 62 are respective interior vertical planes 63 associated with each of left and right foot members 60*a*, 60*b* and exterior vertical planes 64 associated with each of left and right foot members 60*a*, 60*b*. These planes 63, 64 are parallel to vertical longitudinal plane C and to each other. Width $S_L$ of stepping space 62 of the left foot member 60*a* is defined as the distance between the first plane 63 of the left foot member 60*a* and the second plane 64 of the left foot member 60*a*. Similarly, width $S_R$ of stepping space 62 of the right foot member 60*b* is defined as the distance between the first plane 63 of the right foot member 60*b* and the second plane 64 of the right foot member 60*b*. Width $S_L$ of stepping space 62 of the left foot member 60*a* is equal to width $S_R$ of stepping space 62 of the right foot member 60*b*. Additionally shown in FIG. 3 is overall foot member width $W_L$ of the left foot member 60*a*, and overall foot member width $W_R$ of the right foot member 60*b*. Overall foot member widths $W_L$, $W_R$ of each of the left and right foot members 60*a*, 60*b* are defined by respective lateral borders of each foot member 60*a*, 60*b*. Overall foot member width $W_L$ of the left foot member 60*a* is equal to overall foot member width $W_R$ of the right foot member 60*b*. Also widths $W_L$, $W_R$ are greater than or equal to widths $S_L$, $S_R$. As depicted in FIG. 3, a portion of width $W_L$ of the left foot member 60*a* crosses the longitudinal vertical plane C, and so does a portion of width $W_R$ of the left foot member 60*b*.

Figure 4:
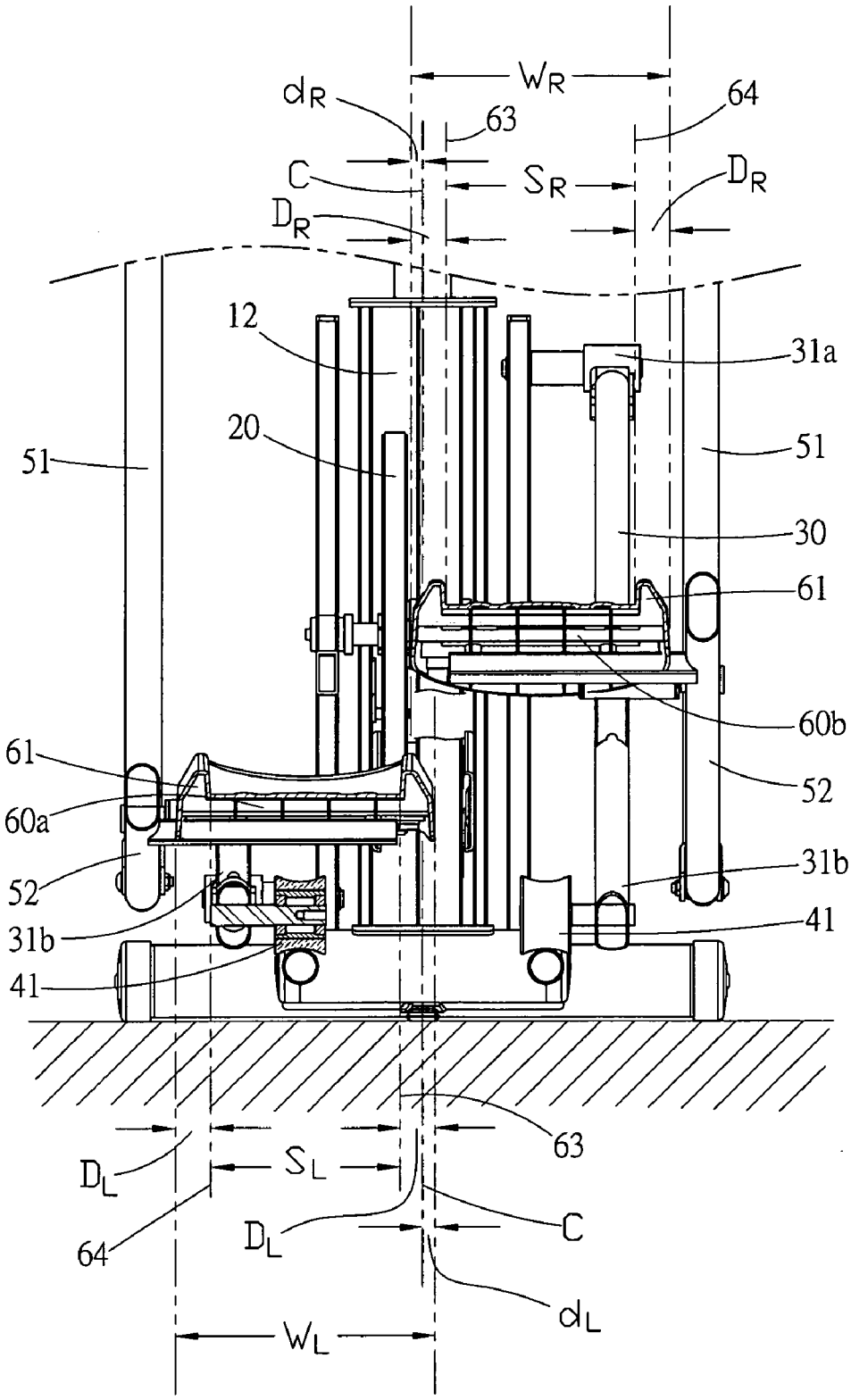
FIG. 4 is a partial cutaway view about the I-I axis of FIG. 2.

Referring to FIG. 4, in the preferred embodiment, the width of the border $W_L$ of the left foot member 60*a* is larger than the width $S_L$ of the stepping space 62 thereof. This is due to the fact that the left foot member 62*a* has surrounding raised surfaces 61 which are configured around the stepping space 62 to positively locate the user's foot during the exercise. As shown, the raised surface 61 of the left foot member 62*a* has a thickness $D_L$, where $2*D_L$ is equal to the width of the border $W_L$ minus the width $S_L$ of the stepping space 62. Similarly, the right foot member 60*b* also has surrounding raised surfaces 61 which are configured around the stepping space 62 to positively locate the user's foot during the exercise. $2*D_R$ is equal to the width of the border $W_R$ minus the width $S_R$ of the stepping space 62.

As can further be seen in FIG. 4, the very right border of the left foot member 60*a* crosses the vertical plane C and has an overlapping distance $d_L$ from the vertical plane C. Similarly, the very left border of the right foot member 60*b* crosses the vertical plane C and has an overlapping distance $d_R$ from the vertical plane C. In this preferred embodiment, $d_L$ is shown as being smaller than $D_L$, and $d_R$ is shown being smaller than $D_R$. When the right foot member 60*b* and the left foot member 60*a* are positioned over one another (with either the left foot member 60*a* being over the right foot member 60*b* or vice versa), a portion of the left foot member 60*a* and a portion of the right foot member 60*b* overhang each other. In other words, during a portion of their travel around a closed loop path, left and right foot members 60*a*/60*b* will have an overhanging area. The maximum amount of overhang will be equal to $d_L$ plus $d_R$.

Referring again to FIG. 3, each of the left and right foot members 60*a*, 60*b* have respective centerlines $L_C$, $R_C$. Because the left and right foot members 60*a*, 60*b* overhang each other, a distance between the centerlines $L_C$, $R_C$ of the left and right foot members 60*a*, 60*b* is smaller than prior elliptical exercise apparatus which have non-overhanging left and right foot members. In other words, the amount of overhang in the present invention causes $d_L$ and $d_R$ to be positive numbers, where in the prior elliptical exercise apparatus where there is no overhang, $d_L$ and $d_R$ would have negative values. This closer foot support platform spacing in the present invention allows the user to place their foot in a more natural position, allowing the foot path of the exercise to be more similar to that of a walking or running person putting each of their feet closer to the centerline of their body.

Although the present invention is adapted to the kind of elliptical exercise apparatus 1 as illustrated in FIG. 1, the invention should not be limited to only this embodiment. One skilled in the art would be able to apply the present invention to many other types of elliptical exercise apparatuses. For example, the distal ends 31*b* of the left and right support members 30 can be slidingly connected to the left and right guiding members 40 without rollers 41. Or, the left and right guiding members 40 would not need to be limited to straight rails.

Another embodiment not shown could use left and right swing arms as guide members, replacing rollers and sliding motion with pivotal motion. The left and right swing arms could be pivotally connected to the frame. These swing arms would modify the motion of the distal end 31*b* of the left and right support members 30, changing them to an arcuate reciprocating motion. In this embodiment, the left and right swing arms and the left and right support members would also cause the left and right foot members to move along substantially elliptical paths. This kind of elliptical exercise apparatus could also be adapted with the present invention to have the same aforementioned advantages.

In the preferred embodiment of FIG. 4, each of the left and right foot members 60*a*, 60*b* cross the longitudinal vertical plane C. As mentioned above, the overhanging distances are $d_L$ and $d_R$ respectively. However, $d_L$ and $d_R$ are adjustable. For example, in order to make the centerlines of the left and right foot members 60*a*, 60*b* move closer horizontally, $d_L$ and $d_R$ can be adjusted simultaneously to set the desired centerline-to-centerline distance between the two foot members 60*a*, 60*b*. Another way to increase or decrease the centerline-to-centerline distance between the two foot members 60*a*, 60*b* is to change the overall width $W_L$, $W_R$ of the each foot member 60*a*, 60*b*. In the present invention, the distance of two centerlines $L_C$, $R_C$ of the left and right foot members 60*a*, 60*b* has a spacing of about 250 mm when the $D_L$ and $D_R$ are zero. However, it could be advantageous to set this distance at about 250 mm, less than 250 mm, less than 220 mm, or less than 190 mm.

The present invention does not require that all the advantageous features and all the advantages need to be incorporated into every embodiment thereof. While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. An exercise apparatus comprising:

a. a frame having a pivot axis and defining a vertical plane;

b. a crank unit for rotation around the pivot axis;

c. a left guide member and a right guide member connected to the frame;

d. a left support member and a right support member, each support member having a first end portion, a middle portion, and a distal portion, wherein the first end portion is connected to the crank unit for rotation in a substantially circular path around the pivot axis and the distal portion of each support member is guided by a respective guide member to move along a reciprocating path; and e. a left foot member and a right foot member, each foot member is connected to a respective middle portion of a support member for movement through a closed loop path that is substantially parallel to the vertical plane, and at least a portion of each foot member crosses through the vertical plane as it moves through the closed loop path.

2. The exercise machine of claim 1, wherein the left guide member and the right guide member are pivotally connected to the frame.

3. The exercise machine of claim 1, wherein the distal portion of each support member is slidingly coupled to a respective guide member.

4. The exercise machine of claim 1, and further comprising:

a first roller, a second roller, and each roller is rotatably connected to a respective support member distal portion.

5. An exercise apparatus comprising:

a. a frame having a pivot axis;

b. a crank unit for rotation around the pivot axis;

c. a left guide member and a right guide member connected to the frame;

d. a left support member and a right support member, each support member having a first end portion, a middle portion, and a second end portion distal to the first end portion, wherein the first end portion is connected to the crank unit for rotation in a substantially circular path around the pivot axis and the second end portion of each support member is guided by a respective guide member to move along a reciprocating path; and e. a left foot member and a right foot member, each foot member is connected to a respective middle portion of a support member, wherein each foot member moves around a closed path that is substantially parallel to the closed path of the other foot member, and wherein at least a portion of the left foot member overlaps a longitudinal plane extending through the right foot member at at least one position along the closed path, and wherein at least a portion of the right foot member overlaps a longitudinal plane extending through the left foot member at at least one position along the closed path.

6. The exercise machine of claim 5, wherein the left guide member and the right guide member are each pivotally connected to the frame.

7. The exercise machine of claim 5, wherein the second end portion of each support member is slidingly coupled to a respective guide member.

8. The exercise machine of claim 5, and further comprising:

a first roller and a second roller, each roller rotatably connected to a respective support member second end portion.

9. The exercise machine of claim 5, wherein the left foot member and the right foot member each moves in a substantially elliptical path.

10. An exercise apparatus comprising:

a. a frame defining a longitudinal line and having a pivot axis;

b. a crank unit for rotation around the pivot axis;

c. a left guide member and a right guide member connected to the frame;

d. a left support member and a right support member, each support member having a first end portion, a middle portion, and a distal portion, wherein the first end portion is connected to the crank unit for rotation in a substantially circular path around the pivot axis while the distal portion of each support member is guided by a respective guide member to move along a reciprocating path; and e. a left foot member and a right foot member, each foot member defining a centerline, and each foot member is connected to a respective middle portion of a support member, wherein the centerline of each foot member is located immediately adjacent to a vertical plane extending through the longitudinal centerline of the exercise apparatus, and wherein each foot member moves through a closed loop that is substantially parallel to the closed loop of the other foot member.

11. The exercise machine of claim 10, wherein the left guide member and the right guide member are each pivotally connected to the frame.

12. The exercise machine of claim 10, wherein the distal portion of each support member is slidingly coupled to a respective guide member.

13. The exercise machine of claim 10, and further comprising:

a first roller and a second roller, each roller is rotatably connected to a respective support member distal portion, for rolling in a reciprocating path.

14. The exercise machine of claim 10, wherein each foot member moves in a substantially elliptical path.

15. The exercise machine of claim 10, wherein the distance between the centerline of the left foot member and a centerline of the right foot member is less than about 250 millimeters.

16. The exercise machine of claim 10, wherein the distance between the centerline of the left foot member and a centerline of the right foot member is less than about 220 millimeters.

17. The exercise machine of claim 10, wherein the distance between the centerline of the left foot member and the centerline of the right foot member is less than about 190 millimeters

18. The exercise machine of claim 10, wherein each foot member includes a pivot portion that is pivotally connected to a respective support member.

19. The exercise machine of claim 10, and further comprising:

a left handle and a right handle, and each handle is pivotally connected to the frame.

* * * * *